US008827280B2

(12) United States Patent
Krenn

(10) Patent No.: US 8,827,280 B2
(45) Date of Patent: Sep. 9, 2014

(54) SNOWBOARD BINDING HAVING REAR ENTRY AND ASYMMETRICAL LEG SUPPORT

(75) Inventor: Thomas Krenn, Perchtordsdorf (AT)

(73) Assignee: Sam Sport and Marketing AG, Scherzingen (CH)

( * ) Notice: Subject to any disclaimer, the term of this patent is extended or adjusted under 35 U.S.C. 154(b) by 7 days.

(21) Appl. No.: 13/260,005

(22) PCT Filed: Mar. 24, 2010

(86) PCT No.: PCT/EP2010/053858

§ 371 (c)(1),
(2), (4) Date: Sep. 23, 2011

(87) PCT Pub. No.: WO2010/112384

PCT Pub. Date: Oct. 7, 2010

(65) Prior Publication Data

US 2012/0061927 A1 Mar. 15, 2012

(30) Foreign Application Priority Data

Apr. 3, 2009 (DE) ..... 10 2009 016 141
Apr. 3, 2009 (DE) ..... 20 2009 004 623 U

(51) Int. Cl.

| | |
|---|---|
| ***A63C 10/00*** | (2012.01) |
| ***A63C 10/12*** | (2012.01) |
| ***A63C 10/28*** | (2012.01) |
| ***A63C 10/10*** | (2012.01) |
| ***A63C 10/08*** | (2012.01) |

(52) U.S. Cl.

CPC ..... *A63C 10/00* (2013.01); *A63C 10/12* (2013.01); *A63C 10/28* (2013.01); *A63C 10/106* (2013.01); *A63C 10/08* (2013.01)

USPC ..... 280/11.33; 280/11.34; 280/14.22; 280/611

(58) Field of Classification Search

USPC ..... 280/11.33, 11.34, 14.22, 611

See application file for complete search history.

(56) References Cited

U.S. PATENT DOCUMENTS

| | | | | |
|---|---|---|---|---|
| 5,556,123 | A * | 9/1996 | Fournier | 280/607 |
| 6,520,511 | B2 * | 2/2003 | Gonthier | 280/11.36 |
| 7,147,233 | B2 * | 12/2006 | Edmond | 280/14.22 |
| 7,246,811 | B2 * | 7/2007 | Martin | 280/611 |
| 2007/0158929 | A1 * | 7/2007 | Neiley et al. | 280/617 |
| 2008/0231020 | A1 | 9/2008 | Elkington | |
| 2008/0258434 | A1 | 10/2008 | Krenn et al. | |

FOREIGN PATENT DOCUMENTS

| | | |
|---|---|---|
| DE | 201 01 389 U1 | 5/2001 |
| DE | 103 05 764 A1 | 8/2004 |

(Continued)

OTHER PUBLICATIONS

International Preliminary Report on Patentability for PCT application PCT/EP2010/053858, filed Mar. 24, 2010, which issued on Nov. 1, 2011 by the International Bureau of WIPO.

*Primary Examiner* — Katy M Ebner
*Assistant Examiner* — Hilary L Johns
(74) *Attorney, Agent, or Firm* — Joyce von Natzmer; Agris & von Natzmer LLP

(57) ABSTRACT

A rear entry snowboard binding (2) comprising a leg support (3) which is pivotably hinged on a binding base plate (5) on the right side and on the left side which can be swivelled between a rear entry position in which a boot to be accommodated in the snowboard binding (2) can be inserted from back to front into the snowboard binding (2), and a front travel position, wherein locking means are provided for blocking the leg support (3) in the travel position, which comprise a locking lever (6) pivotably hinged on the rear side of the leg support (3), wherein at least in the travel position relative to a center plane (11) of the binding (2) which runs in the longitudinal direction of the binding base plate (5) and stands vertically on the binding base plate (5) centrally between the two lateral hinge points (9) of the leg support (3), the leg support (3) projects further outwards to a first side (12R) than to the opposite second side (12L), and wherein the locking lever (6) hinged pivotably on the rear side of the leg support (3) extends with a free activation region (14) laterally away from the leg support (3).

18 Claims, 4 Drawing Sheets

(56) References Cited

FOREIGN PATENT DOCUMENTS

| | | | | |
|---|---|---|---|---|
| DE | 20 2008 000 714 | U1 | | 7/2008 |
| EP | 749703 | A1 | * | 12/1996 |
| EP | 1 927 381 | A1 | | 6/2008 |
| FR | 2 829 943 | A1 | | 3/2003 |
| WO | 01/49381 | A1 | | 7/2001 |
| WO | 2004073811 | A1 | | 9/2004 |

* cited by examiner

SNOWBOARD BINDING HAVING REAR ENTRY AND ASYMMETRICAL LEG SUPPORT

This is the U.S. national stage of International application PCT/EP/2010/053858, filed Mar. 24, 2010 designating the United States and claiming priority to DE 10 2009 016 141.4, filed Apr. 3, 2009 and DE 20 2009 004 623.0, filed Apr. 3, 2009.

The present invention relates to a snowboard binding according to the preamble of claim 1. Such bindings are also designated as "soft binding" or "highback binding" since they are provided to be used with relatively soft snowboard boots and have a high flexibility such as desired, for example, by so-called "freestyle riders". In contrast, the present invention does not relate to so-called "hard bindings" in which a relatively hard ski boot or a ski-boot like snowboard boot is fixed in the binding by overlapping of projections or recesses on or in the hard sole of the boot.

The binding according to the invention is used for fixing a snowboard boot on a snowboard. It is designed as a so-called rear entry binding and comprises for this purpose a leg support which is hinged so that it can pivot between a rear entry position in which a boot can be inserted particularly easily from back to front into the snowboard binding or can be removed from the binding in the opposite direction, and a front travel position. A very convenient entry into and exit from the binding is made possible in this manner known per se.

The usual leg support in such snowboard bindings, which is also designated as "highback" or "rear spoiler", serves to support the back of the snowboard boot or the calf bone of a snowboarder towards the rear. The leg support is thereby pivotably mounted about an axis aligned transversely to the longitudinal direction of the base plate in order to be able to set a certain angle of inclination which defines the so-called forward pass of the lower leg of a snowboarder. To this end the angle of inclination of the leg support can usually be adjusted for the travel position desired by the rider.

In the travel position the leg support is fixed by a suitable locking device or suitable locking means. For exiting from the snowboard binding the locking device or the locking means are released so that the leg support is folded back rearwards into the open position or entry position again and the boot can be removed from the binding. The locking means in this case can comprise at least one tension means embracing the leg support, in particular a cable, that can be tensioned by a locking lever for fixing a boot.

Furthermore, the swivellability can advantageously also be used so that the leg support, which in practice in the normal travel position is at a distance of about 20 to 30 cm from the snowboard surface, can be folded forwards onto the surface of the snowboard so that it is less interfering when transporting and storing the snowboard.

In contrast, the present invention does not relate to such "soft bindings" in which the rear leg support is designed to be fixed, which is known in particular in bindings having a heel clip, which is also designated as heelcup.

The binding according to the invention further comprises a toe element and/or at least one instep element by which means a boot held in the snowboard binding can be fixed in cooperation with the leg support.

A binding according to the preamble of claim 1 is known from the document DE 20 2008 000 714 U1 or also from DE 103 05 764 A1. In this case a boot to be fixed in the binding is firmly clamped between two side cheeks located on the right and the left on the binding base plate and between a front toe element and the rear-hinged leg support. Locking means are provided for blocking the leg support in the travel position, which means comprise a locking lever pivotably hinged on the rear side of the leg support, which can cooperate in particular with a cable fastened to fixed parts of the binding.

In this binding, as in other known rear entry snowboard bindings, the leg support is disposed symmetrically to a centre plane running in the longitudinal direction of the binding and located perpendicularly on the binding base plate. This means that the leg support, at least in its front travel position, extends substantially straight or perpendicularly upwards in a direction of observation running in the longitudinal direction of the binding.

When using bindings on a snowboard, the legs of the snowboarders are, however, always slightly splayed in the form of a straddle. This means that there is always a certain inward sloping position of the rider's legs. As a result of this sloping position, optimal support of the rider's calf bones is not possible with a symmetrical alignment of the leg support. Another disadvantage is that depending on the angle of the sloping position of the legs, a symmetrically or even straight-upwardly aligned leg support can even result in compressive loads at points, which are perceived by the rider as perturbing or even as painful when riding specific figures.

On a freestyle snowboard the legs of the rider are frequently also bent outwards from one another so that here also optimal support of the rider's calf bones is not possible with a symmetrical alignment of the leg supports. Here also compressive loads can occur due to the leg supports which are particularly perceived by freestyle riders as painful when riding specific figures.

A snowboard binding is known from DE 201 01 389 U1 in which the leg support has at least one laterally projecting section which can abut with its inner surface against one side of the shaft of a boot fixed in the binding. However, this snowboard binding cannot be used as a rear entry binding as a result of a continuous rigid heel clip. Entry into the binding and exit from the binding is therefore relatively uncomfortable and associated with correspondingly high effort when closing or opening the retaining straps configured as instep element and toe element.

It is the object of the present invention to provide a snowboard binding that is constructively simple and inexpensive to manufacture, which whilst being comfortable to enter and exit, ensures a particularly good support of the user's legs at the back and avoids unpleasant compressive loads and which is at the same time particularly easy and comfortable to operate when opening and closing the binding.

This object is solved according to the invention by a snowboard binding according to claim 1. Advantageous embodiments and further developments of the invention are obtained from the dependent claims.

In the solution according to the invention it is essential that at least in the folded-forward travel position relative to a centre plane of the binding which runs in the longitudinal direction of the binding base plate and stands vertically on the binding base plate centrally between the two lateral hinge points of the leg support, the leg support projects further outwards to the right side or to the left side, which is designated here as first side, than to the opposite second side, which is designated here as second side. The hinged leg support therefore exhibits an asymmetric alignment differing from the central profile.

In the solution according to the invention, it is furthermore essential that the locking lever hinged pivotably on the rear side of the leg support extends with its free activation region formed by its free end towards one side projecting from the main direction of extension or away from the centre line of the leg support.

An essential advantage of the snowboard binding according to the invention is that the leg support can adapt substantially better to the sloping position of the legs of a snowboarder as a result of the alignment tending to one side. As a result, even when the legs of a rider are in straddle-shaped alignment, an optimal support is always ensured. High local compressive loads on the calf bone which are perceived as unpleasant can thus be avoided. At the same time, the possibility of a particularly easy entry into the binding and exit from the binding provided by the comfortable rear entry is preserved. These advantages apply both for a leg position inclined inwards onto one another and for an inclination of the legs away from one another outwards which is possible in particular in freestylers.

At the same time, as a result of the alignment of the free activation region of the locking lever extending away from the leg support, a significant simplification of the operation of the locking means is achieved since the rider no longer needs to grip so far around the leg to be able to grasp and operate the locking lever. Such an asymmetric configuration of the locking lever therefore results in a further increase in the comfort of the binding, which is another essential advantage of the snowboard binding according to the invention.

According to a particularly preferred embodiment of the invention it is provided that the locking lever hinged pivotably on the rear side of the leg support extends with its free activation region formed by its free end laterally away from the leg support in a direction, which projects to the second side facing away from the first side to which the leg support projects further outwards relative to the centre plane of the binding.

This means that, for example, the free activation region of the locking lever in relation to the leg support projects to the right when the leg support itself projects to the left relative to the centre plane of the binding. The locking lever is thereby also configured to be symmetrical relative to the leg support. In this configuration the locking lever can be reached particularly easily by the snowboarder.

The advantage of a particularly convenient operation of the binding is made particularly noticeable if the locking lever extends in a direction which, relative to the centre plane of the binding running in the longitudinal direction, projects to the side facing away from the first side to which the leg support projects further outwards relative to the centre plane of the binding. The locking lever can be gripped particularly easily since it then projects even further laterally.

It is furthermore particularly advantageous if the free end of the activation region of the locking lever projects to one side and/or upwards over the side edge of the leg support. As a result, it is particularly easy and simple to grip the locking lever.

It is preferably proposed to this end that the activation region of the locking lever runs in a central direction which encloses an angle lying between 15° and 70°, preferably between 30° and 60°, to the central direction of the upper end region of the leg support, which allows the locking lever to be grasped particularly easily even with thicker gloves.

It is furthermore particularly advantageous if the locking lever overall has an arcuate curved shape. An ergonomically particularly favourable shape is hereby achieved, which is particularly easy to grip.

It is particularly advantageous here if a larger proportion in terms of area of the contact surface of the leg support resting on the rear side of a boot and/or against the calf bone of a rider in the front travel position is located on the first side of the centre plane of the binding. The leg support thereby has an asymmetric shape which is adapted to the leg position of the rider.

A particularly good adaptation to the sloping position of the legs of the rider can be achieved whereby the upper end region of the leg support on the first side runs in a direction which encloses an angle to the centre plane of the binding, which lies between 3° and 40°, preferably between 10° and 25°.

It is furthermore particularly advantageous if the two lateral hinge points of the leg support define a pivot axis running parallel to the binding base plate. These two lateral hinge points of the leg support preferably lie on two side cheeks of the binding between which a boot to be fixed in the binding is accommodated. In an alternative embodiment of the binding, however, the pivot axis of the leg support can run at an angle obliquely to the binding base plate, where this angle can be fixedly predefined or preferably also adjustable.

It is furthermore favourable if the pivot axis of the locking lever runs parallel to the pivot axis of the leg support, where both pivot axes preferably run parallel to the binding base plate. Alternatively, however, it is also possible that the two pivot axes of the locking lever and the leg support are inclined obliquely at an angle to one another in order to thus ensure that the free end region of the locking lever is particularly easily reachable for the user particularly coordinated to the shape of the locking lever.

According to a particularly preferred embodiment of the invention it can be provided that in addition to its swivellability forwards or backwards, the leg support can be additionally pivoted or positioned obliquely about a second axis which is aligned at least substantially perpendicularly to the base plate of the binding. As a result of the slight sloping position of the leg support which can be achieved thereby, this can advantageously be approximated to the alignment of the longitudinal edges of a snowboard or even aligned parallel thereto. Regardless of this, the asymmetric deflection of the leg support to one side is retained.

It is particularly advantageous if at least one hinge point of the leg support can be displaced forwards or backwards on the leg support in a direction which, when the leg support is folded up into the front travel position, runs at least approximately parallel to the base plate of the binding. By means of suitable fixing means the hinge point can then be locked in a position desired by the user. Preferably both hinge points of the leg support are each mounted displaceably on both sides.

A particularly simple and at the same time robust design can be achieved whereby the displaceable hinge point of the leg support comprises an adjusting screw disposed on a side cheek of the binding which can be turned from outside and which is screwed into an adjusting nut, which is disposed in a longitudinal recess of the leg support, which extends in the direction in which the hinge points can be displaced.

The fixing means for locking the hinge point in a desired position can be formed particularly simply and effectively by a toothed structure and a mating toothed structure which is effective between the adjusting nut and the leg support. Upon tightening the screw, the toothed structure thus results in a positive hold of the adjusting nut in the longitudinal recess which is cancelled by loosening the screw so that the screw and nut can then be displaced relative to the leg support, which leads to the desired oblique position of the leg support by swivelling.

The present invention relates in particular to a set comprising two rear-entry snowboard bindings comprising a left and a right binding in which the leg supports of the two bindings each project further outwards to mutually opposite sides relative to the respective centre plane of the binding. The two bindings of the set are configured as a mirror image of one another which always allows an optimal support of both calf bones of the snowboarder regardless of which binding is mounted at the front or the back on the snowboard.

The present invention further relates to a snowboard provided with two bindings of the type described previously in which the bindings are mounted such that the two leg supports each project further laterally relative to the respective centre plane of the binding in the direction of the respectively other binding.

Further advantages and features of the invention are obtained from the following description and the exemplary embodiments shown in the drawings.

Figure 1:
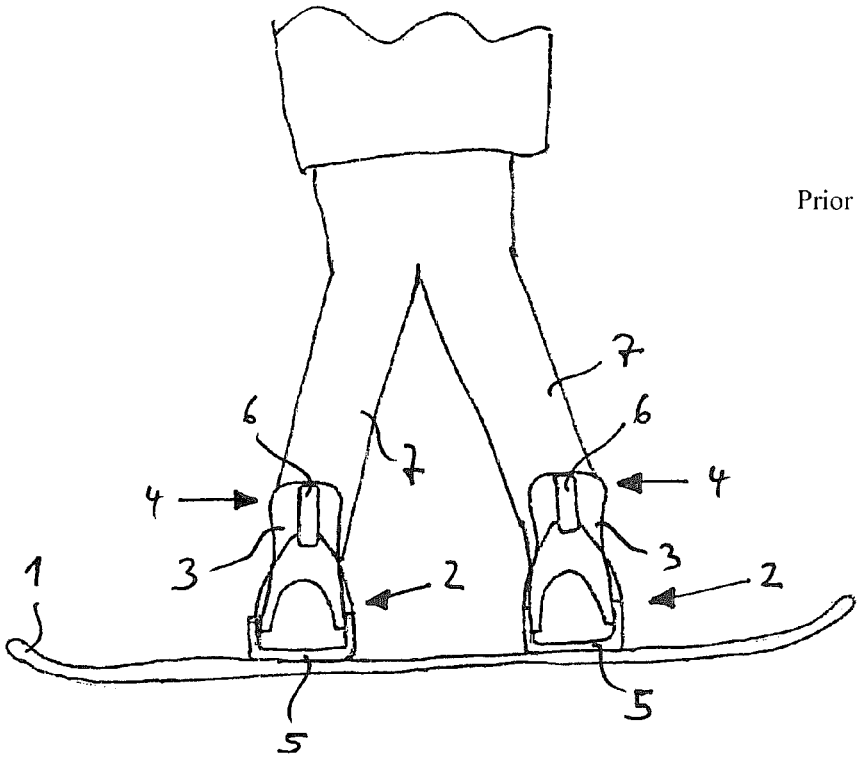
Prior Art Fig. 1
FIG. 1 shows a schematic view of a snowboard with two conventional rear-entry snowboard bindings according to the prior art.

The two snowboard bindings 2 mounted on the snowboard 1 shown in FIG. 1 are designed symmetrically in the hitherto known embodiment. The two leg supports 3 thereby extend substantially straight as far as their upper end regions 4 and, when viewed from behind, perpendicularly upwards to the respective base plate 5 of the binding 2. The locking levers 6 mounted on the rear side of each of the leg supports 3 run symmetrically vertically upwards here in the centre of the leg supports 3.

It can be clearly seen that the legs 7 of the rider are positioned sloping inwards in a certain straddle position and that as a result, no optimal support of the legs 7 by the two leg supports 3 is provided.

Figure 2:
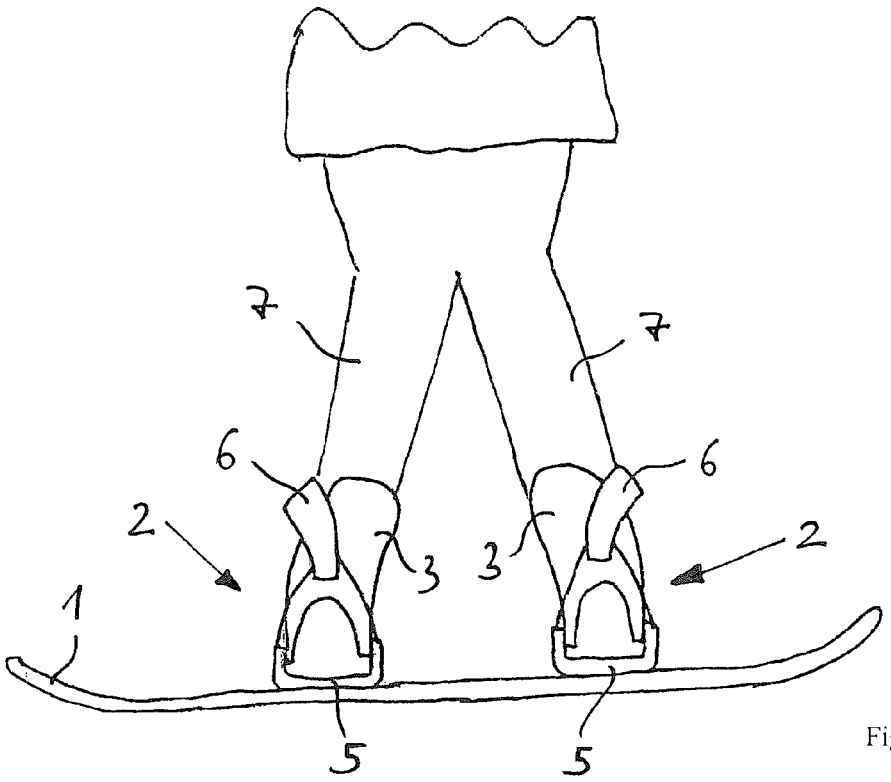
FIG. 2 shows a schematic view of a snowboard with two rear-entry snowboard bindings according to the invention.

In contrast to this, the two snowboard bindings 2 shown in FIG. 2 are designed asymmetrically according to the invention. The two leg supports 3 each extend obliquely inwards to the respectively other binding 2 so that they are adapted to the oblique position of the legs 7 of the rider, which ensures a significantly improved support of the calf bones. At least the upper regions of the leg supports are inclined towards the first side which lies on the inside here.

At the same time, the locking levers 6 each mounted on the rear side of the leg supports 3 are configured asymmetrically, with these each running obliquely outwards, i.e. in the opposite direction to the direction of the slope of the respective leg supports 3. As a result, the rider does not need to grip so far around his leg 7 to be able to reach the locking lever 6, which leads to a significant simplification of the operation of the snowboard binding 2. Overall the locking levers 6 which cooperate in a manner known per se with respectively one cable 31 fastened on a fixed part of the binding 2, are each configured to be curved towards the outside in an arcuate manner.

Figure 3:
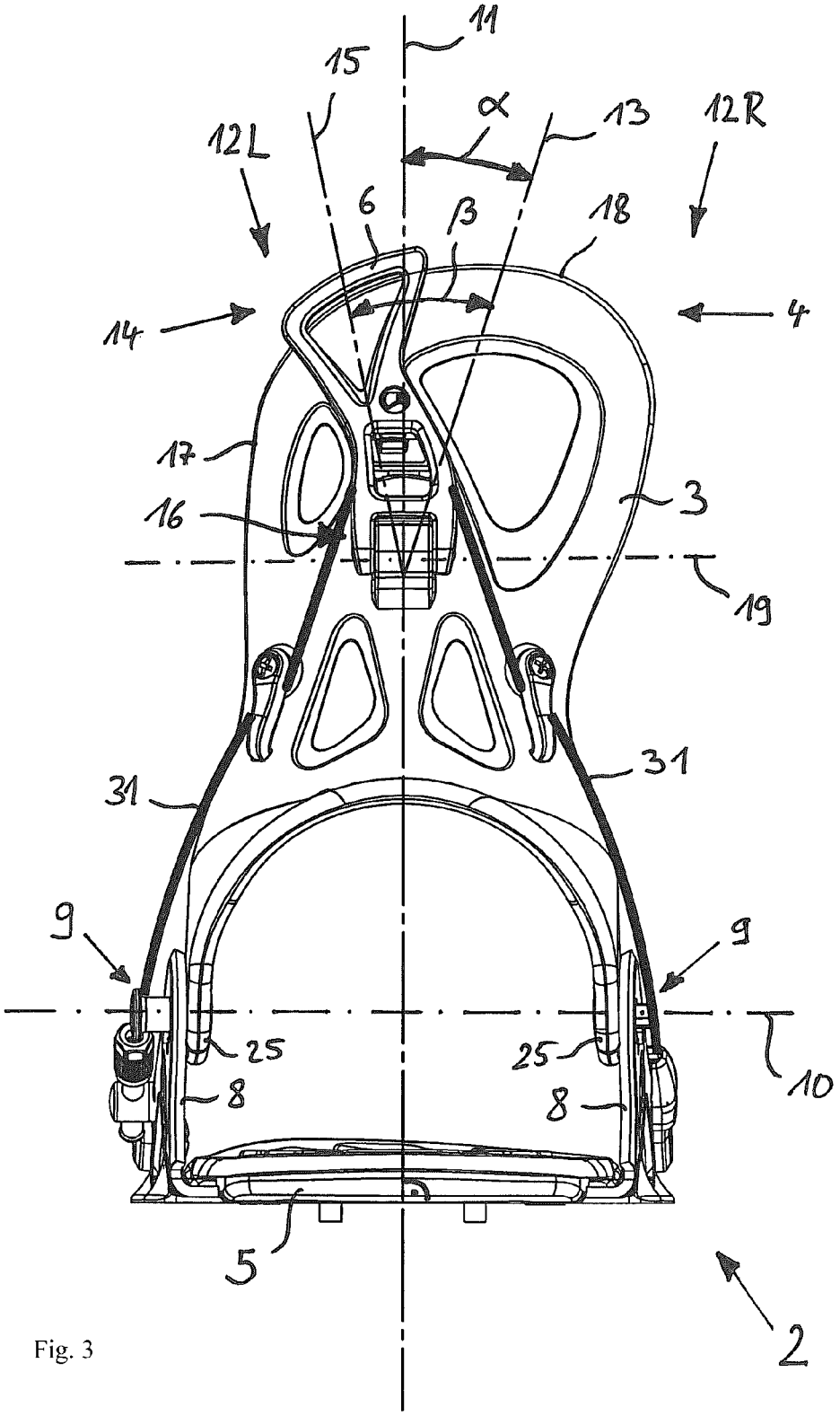
FIG. 3 shows a rear view of a snowboard binding according to the invention.
Figure 4:
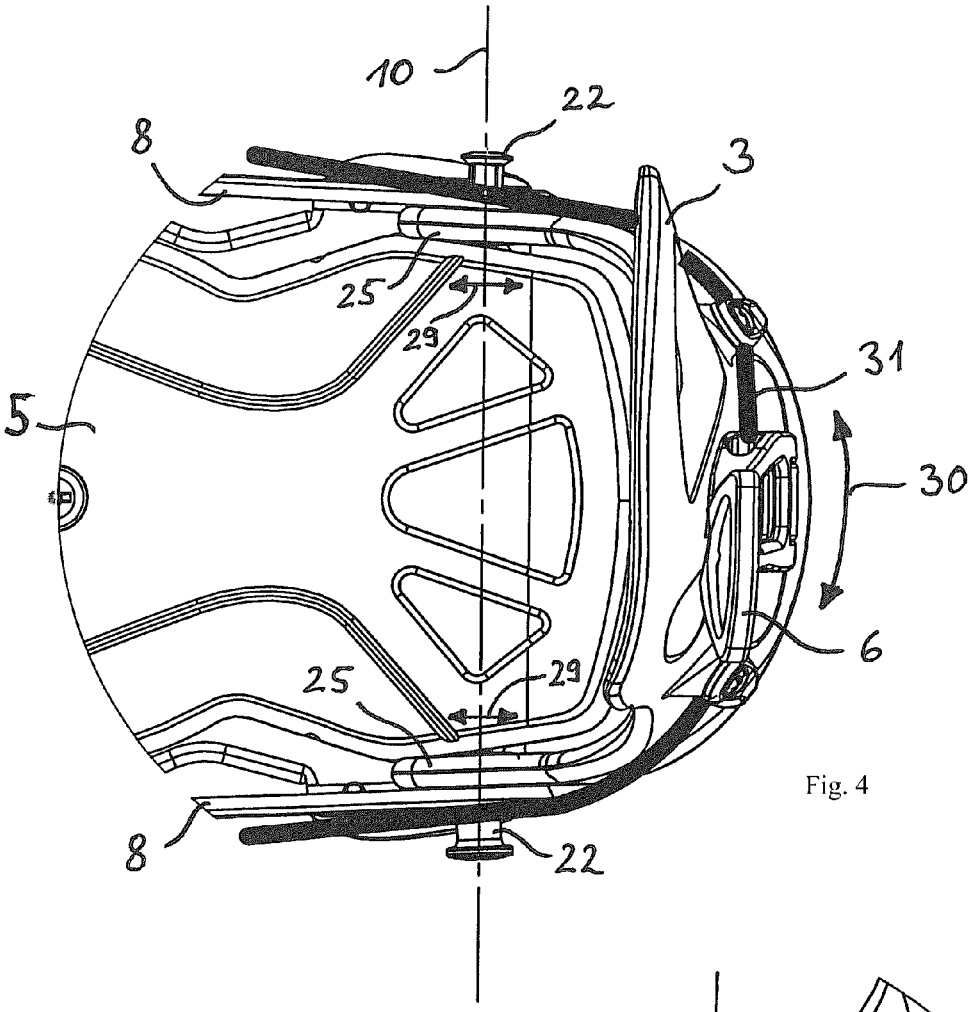
FIG. 4 shows a partial view of one embodiment of a snowboard binding from above'
Figure 5:
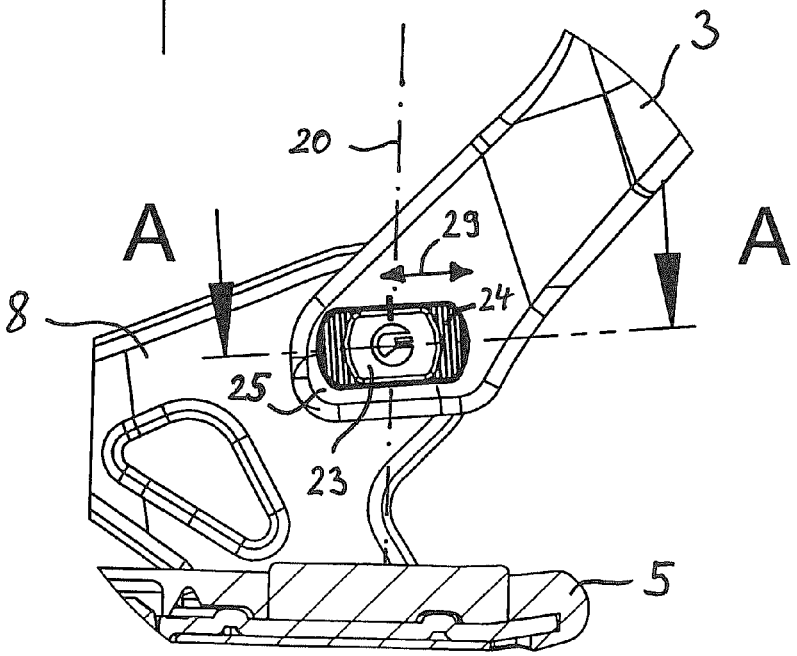
FIG. 5 shows a partial view of the embodiment from FIG. 4.

FIG. 3 shows an enlarged rear view of a snowboard binding 2 according to the invention in which the leg support 3 is in the travel position folded up towards the front. The leg support 3 is hinged to the two side cheeks 8 at two hinge points 9 which define a pivot axis 10 running parallel to the binding base plate 5. The reference number 11 here characterises the centre plane of the binding 2 which runs in the longitudinal direction of the binding base plate 5 and stands perpendicularly on the binding base plate 5 centrally between the two lateral hinge points 9. The leg support 3 is inclined laterally to the right with respect to this centre plane 11 so that a larger proportion of the leg support 3 in terms of area projects outwards to the right side 12R, which forms the first side here, than to the left side 12L.

The lateral projection of the leg support 3 to the right side 12R, when viewed from behind, is configured here in such a manner that the centre of the upper end region 4 of the leg support 3 runs in a direction 13 which encloses an angle $\alpha$ of 15° to the centre plane 11.

The locking lever 6 hinged pivotably on the rear side of the leg support 3 extends with its free activation region 14 inclined laterally to the left away from the leg support 3. It is therefore also configured asymmetrically. Overall the central longitudinal extension of the locking lever 6 runs in the direction 15 which encloses an angle $\beta$ of 30° with the central direction 13 of the upper end region 4 of the leg support 3. The locking lever 6 has an overall S-shaped profile, where its inner or lower region 16 is initially curved to the left when viewed from behind, and this is adjoined towards the outside by the activation region 14 of the locking lever 6 which is curved in an arcuate manner to the right.

The free end of the activation region 14 of the locking lever 6 projects completely to the left over the left side edge 17 or upwards over the upper side edge 18 of the leg support 3.

The pivot axis 19 of the locking lever 6 here runs parallel to the pivot axis 10 of the leg support 3 so that both pivot axes 10 and 19 run parallel to the binding base plate 5 despite the asymmetric configurations of the leg support 3 and the locking lever 6.

Figure 6:
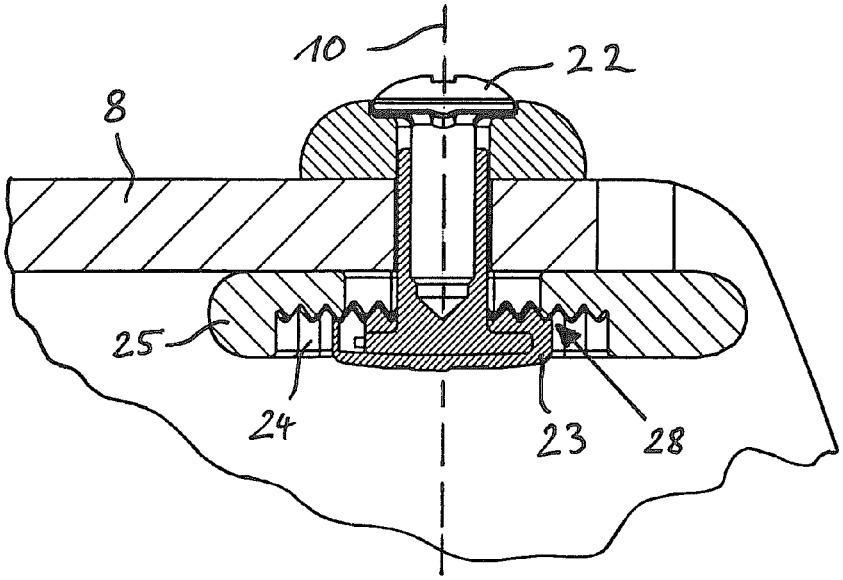
FIG. 6 shows a partial view along the line of intersection A-A from FIG. 5 in the locked state of the leg support in relation to the pivotability about a perpendicular axis.
Figure 7:
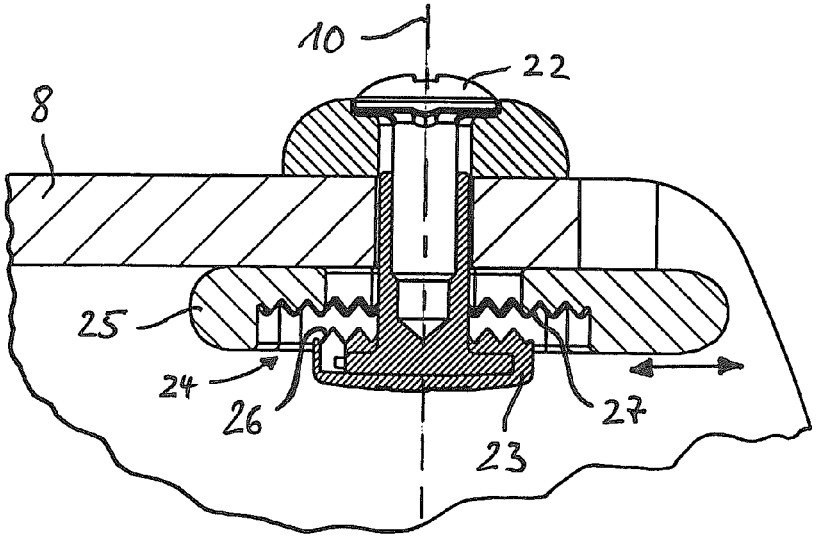
FIG. 7 shows a sectional view along the line of intersection A-A from FIG. 5 in the released state of the leg support in relation to the pivotability about a perpendicular axis.
Figure 8:
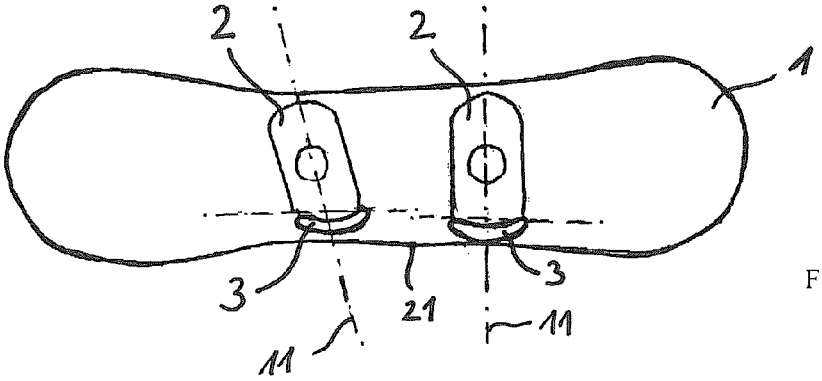
FIG. 8 shows a schematic view of a snowboard with two snowboard bindings according to FIG. 4.

In the embodiment of a binding 2 according to the invention shown in FIGS. 4 to 8, the leg support 3 can be additionally pivoted about an axis 20 standing vertically on the base plate 5, which then leads to a slight slope of the leg support 3. In this way, the leg supports 3 of a pair of bindings 2 mounted on a snowboard 1 can be adjusted so that, as shown in FIG. 8, the leg supports 3 are each aligned substantially parallel to the side edge 21 of the snowboard 1 (FIG. 8). In addition, the two leg supports 3 are furthermore deflected asymmetrically, where the two leg supports 3 each project further laterally in relation to the centre plane 11 of the binding 2 in the direction of the respectively other binding 2, i.e. in FIG. 8 towards the centre of the snowboard 1.

An adjusting screw 22 running coaxially to the first pivot axis 10 of the leg support 3 is provided here at each of the hinge points 9 of the leg support 3. This adjusting screw 22 is screwed into an elongate adjusting nut 23 which lies in a twist-proof manner in a longitudinal recess 24 formed in the front end of the hinge leg 25 of the leg support 3. This longitudinal recess 24 runs parallel to the base plate 5 when the leg support 3 is folded up into the front travel position.

Positively acting tooth means 26, 27 are provided between the base of the longitudinal recess 24 and the opposite side of the adjusting nut 23, which means here serve as fixing means 28 for blocking the displaceable hinge point 9 in a position desired by the user (FIG. 6). When the adjusting screw 22 is released, the toothed structures 26 and 27 are disengaged and the relevant hinge leg 25 can be displaced in the direction 29 to the front or rear whereby the relevant hinge point 9 of the leg support 3 accordingly migrates to the back or front and when viewed from above, results in a desired slope or swivelling of the leg support 3 in the direction 30 (FIG. 7). The adjusting screw 22 is then tightened again, whereby the toothed structures 26 and 27 are brought into positive engagement again and e fix the relevant hinge point 9 again without blocking the pivotability of the leg support 3 about the horizontal main pivot axis 10 (FIG. 6).

The invention claimed is:

1. A rear entry snowboard binding comprising an asymmetric leg support which is pivotably hinged via two lateral hinge points on the right side and on the left side on a binding base plate and can be swiveled between a rear entry position in which a boot to be accommodated in the snowboard binding can be inserted from back to front into the snowboard binding, and a front travel position, wherein locking means are provided for blocking the asymmetric leg support in the travel position, which comprise a locking lever pivotably hinged on the rear side of the asymmetric leg support, wherein in the travel position relative to a center plane of the binding which runs in the longitudinal direction of the binding base plate and stands vertically on the binding base plate centrally between the two lateral hinge points of the asymmetric leg support, the asymmetric leg support projects further outwards to a first side than to the opposite second side, and the locking lever hinged pivotably on the rear side of the asymmetric leg support projects beyond an edge of the asymmetric leg support.

2. The binding according to claim 1, wherein the locking lever hinged pivotably on the rear side of the leg support extends with a free activation region laterally away from the leg support in a direction, which projects to the side facing away from the first side to which the leg support projects further outwards relative to the center plane of the binding.

3. The binding according to claim 1, wherein the locking lever extends in a direction which, relative to the center plane of the binding, projects to the side facing away from the first side to which the leg support projects further outwards relative to the center plane of the binding.

4. The binding according to claim 1, wherein the locking lever hinged pivotably on the rear side of the leg support extends with a free activation region laterally away from the leg support in a direction, which projects to the same side to which the leg support projects further outwards relative to the center plane of the binding.

5. The binding according to claim 1, wherein the locking lever projects laterally and/or upwards over a side edge of the leg support.

6. The binding according to claim 1, wherein an activation region of the locking lever runs in a direction which encloses an angle (β) lying between 15° and 70° , to a direction in which an upper end region of the leg support extends.

7. The binding according to claim 1, wherein the locking lever overall has an arcuate or S-shaped curved shape.

8. The binding according to claim 1, wherein a large proportion of the contact surface of the leg support resting on the rear side of a boot and/or a leg of a rider in the travel position is located on the first side of the center plane of the binding.

9. The binding according to claim 1, wherein an upper end region of the leg support runs to the first side in a direction which encloses an angle (α) to the center plane of the binding, which lies between 3° and 40°.

10. The binding according to claim 1, wherein the two lateral hinge points of the leg support define a pivot axis running parallel to the binding base plate, wherein the pivot axis of the locking lever runs parallel to the pivot axis of the leg support.

11. The binding according to claim 1, wherein the leg support is mounted on the binding so that it can pivot about a second axis, which is aligned at least substantially perpendicular to the base plate of the binding.

12. The binding according to claim 11, wherein at least one hinge point of the leg support is disposed displaceably on the leg support in a direction which, when the leg support is folded up into the front travel position, runs at least approximately parallel to the base plate of the binding, wherein fixing means for blocking the hinge point in a desired position are provided.

13. The binding according to claim 12, wherein the displaceable hinge point of the leg support comprises an adjusting screw disposed on a side cheek of the binding, which is screwed into an adjusting nut, which is disposed in a longitudinal recess of the leg support, which extends in the direction of displaceability of the hinge point.

14. The binding according to claim 13, wherein the fixing means for blocking the hinge point in a desired position are formed by a toothed structure and a mating toothed structure effective between the adjusting nut and the leg support.

15. Set comprising two rear-entry snowboard bindings according to claim 1, wherein the leg supports of the two bindings each project further outwards to mutually opposite sides relative to the respective center plane of the binding.

16. A snowboard having two rear entry snowboard bindings mounted thereon according to claim 1, wherein the leg supports of the two bindings each project further laterally relative to the respective center plane of the binding in the direction of the respectively other binding.

17. The binding according to claim 6, wherein the angle (β) lies between 30° and 60°.

18. The binding according to claim 9, wherein the angle (α) lies between 10° and 25°.

* * * * *